US006460490B1

(12) United States Patent
Knauss

(10) Patent No.: US 6,460,490 B1
(45) Date of Patent: Oct. 8, 2002

(54) FLOW CONTROL SYSTEM FOR A FORCED RECIRCULATION BOILER

(75) Inventor: Donald T. Knauss, Severna Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/022,544

(22) Filed: Dec. 20, 2001

(51) Int. Cl.[7] ..... F22D 1/00
(52) U.S. Cl. ..... 122/7 R; 122/1 C
(58) Field of Search ..... 122/7 R, 1 C, 122/470, 479.1

(56) References Cited

U.S. PATENT DOCUMENTS

| | | | | |
|---|---|---|---|---|
| 4,128,994 | A | 12/1978 | Cheng | |
| 4,499,721 | A | 2/1985 | Cheng | |
| 5,329,758 | A | 7/1994 | Urbach et al. | |
| 5,566,542 | A | 10/1996 | Chen et al. | |
| 5,628,179 | A * | 5/1997 | Tomlinson | 122/7 R |
| 5,660,799 | A * | 8/1997 | Motai et al. | 122/470 |
| 6,216,443 | B1 | 4/2001 | Utamura | |
| 6,401,667 | B2 * | 6/2002 | Leibig | 122/1 B |

OTHER PUBLICATIONS

J.L. Mangan and R.C. Pettit, "Combined–Cycle with Unfired Boiler Has High Efficiency", Part I, Power Engineering, v. 67, No. 8, pp. 49–51, Aug. 1963.

J.L. Mangan and R.C. Pettit, "Combined Cycle with Unfired Boiler Has High Efficiency–Part II", Power Engineering, v. 67, No. 9, pp. 47–49, Sep. 1963.

(List continued on next page.)

*Primary Examiner*—Jiping Lu
(74) *Attorney, Agent, or Firm*—Steven W. Crabb

(57) ABSTRACT

A forced-recirculation boiler (FRB) type of heat-recovery steam generator is applied to a ship-propulsion application of the recuperative dual-fluid engine. Such boilers generally include an economizer, evaporator and superheater, and incorporate a steam drum for controlling the flow of water-steam mixture through the evaporator. By altering the flow system of the FRB, the stability and integrity of the boiler are maintained by simultaneously providing, under any predetermined off-design, gas-side flow conditions, means for (1) limiting the gas-side cold corrosion of said boiler tubes through tube-wall temperature control, and (2) introducing a controllable sensible component into the heat load of said evaporator, thereby enabling, for any predetermined off-design steam rate, stable evaporator operation at a predetermined design steam quality. One embodiment of the invention is achieved by adding to the flow circuit of the economizer a recirculation loop that enables, through diversion of the water flows within the loop, the conditioning of the flows to both the economizer and the steam drum. Simulation of the operation of the flow-system invention along the power-profile curve of the engine has demonstrated the efficacy of the flow-system in enabling, at any particular point on the power-profile curve, the predetermined steam rate needed for optimum performance of the engine.

9 Claims, 4 Drawing Sheets

OTHER PUBLICATIONS

J.B. Woodward, "Ideal Cycle Evaluation of Steam Augmented Gas Turbines", Journal of Ship Research, v. 40, No. 1, pp. 79–88, Mar. 1996.

W. Xueyou, W. Yingxin, J. Jierong, F. Zhen, "A Gas Turbine Propulsion Plant with the Capability to Provide Steam for Both Injection and Aircraft Catapults", American Society of Mechanical Engineers, Paper 96–GT–326.

M. Kuntz, "Mechanical Engineer's Handbook", J. Wiley and Sons, New York, pp. 1867–1870.

J.L. Boyen, "Thermal Energy Recovery", J. Wiley and Sons, New York, pp. 191–203.

A. Bukowiecki, "Physikalisch–Chemische Betrachtungen zur Frage der Rauchgasseitigen Korrosionserscheinungen im Dampfkesselbetrieb", Schweizer Archiv, pp. 180–220, Mai 1961. ("Cold Corrosion in Oil–Fired Boilers"; discusses importance of maintaining the temperature of the exhaust gas above the acid dew point).

* cited by examiner

Nomenclature of Fig. 1.

Reference conditions of Table 1.

$Q_{EVAP} = Q_{LAT} + Q_{SEN}$ $F = (Q_{SEN}/Q_{EVAP}) \times 100$ $R_S$ = STEAM TURNDOWN RATIO $(m_S)_{DESIGN} / m_S$ $R_m$ = DRUM-WATER MIXING RATIO = $m_m / m_f$

SHAF = SENSIBLE-HEAT AUGMENTATION FACTOR
= $Q_{SEN}/(Q_{SEN})_{DESIGN}$

FLOW CONTROL SYSTEM FOR A FORCED RECIRCULATION BOILER

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

This invention relates to dual-fluid turbine engines, and more particularly, to a flow control system for a dual-fluid gas turbine engine that utilizes a heat-recovery steam generator to generate steam for power augmentation.

A recuperative dual-fluid engine (RDFE) is a gas-turbine engine in which steam generated by a heat-recovery steam generator (HRSG) is used for power augmentation. Either parallel-compound, dual-fluid engines, wherein waste-heat steam is injected into their working fluid, or series-compound, dual-fluid engines wherein power is augmented by an expander operating solely on waste-heat steam are the usual methods to achieve power augmentation with steam.

The present invention relates to the parallel-compound RDFE wherein waste-heat steam is injected into the working fluid of a dual-fluid, gas turbine engine used for ship propulsion, the part-power performance of the gas turbine engine being optimized by means of a highly versatile steam-rate control system.

Over the past few decades, the land-based power industry has exhibited an increasing use of RDFE-type plants. This commercial development has been spurred primarily by the fact that the thermal efficiency of the RDFE is markedly better than that of the simple-cycle engine. Theoretical investigations of the performance of parallel-compound dual-fluid engines at high steam/air mass ratios have confirmed that the RDFE has potential for substantial increases in both power density and specific power. However, the development that markedly enhanced the engine's suitability for propulsion applications was described in U.S. Pat. No. 4,128,994 issued to Cheng, which is hereby incorporated by reference, that showed that when, at any point on the predetermined power-profile curve of the RDFE, the flow of a second parallel working fluid (steam) is controlled so as to produce the maximum degree of superheating, the thermal efficiency of the RDFE is also maximized.

For many RDFE propulsion applications, the most attractive type of HRSG is the Forced-Recirculation Boiler (FRB). This is partially due to the compactness afforded by the forced-recirculation flow system incorporated into its design. Moreover, this type of RSG is inherently superior to unrecirculated boilers from the standpoint of uniformity of flow distribution and the control of both the dissolved solids in the boiler water and the superheat temperature of the product steam. The FRB generally has an economizer, evaporator, and superheater that generally consist of a plurality of heat-transfer surfaces such as finned tubes. The flow system of FRBs is well known to those skilled in the art.

FIG. 3 illustrates the prior art principles of FRB operation. Feedwater-pump 80 delivers pressurized water from the water supply to economizer 81, which heats the water to a temperature slightly below the saturation condition and delivers it to steam-drum 84. The steam-drum is made up of a steam separator and a quantity of water equal to about two-thirds of the steam drum volume. Where control of the tube-wall temperature of the economizer is not required, the flowrate of the economizer water is only slightly higher than that of the steam leaving the steam drum 84, with the excess compensating for the water lost in continuous blowdown of the steam drum. Blowdown is critical to the control of dissolved solids that collect at the bottom of the steam drum. In cases where tube-wall temperature control is needed, the flow through the economizer 81 is increased to provide a drum-bypass stream for raising the temperature of the feedwater delivered to the FRB. Recirculation pump 85 delivers water from the steam-drum 84 to the inlet of evaporator 82, which vaporizes a portion of the water and delivers the water-steam mixture to the steam separator; the separator is effective for collecting the saturated steam and sending it to superheater 83. By operating the evaporator at a flow rate much higher than that in the superheater 83, the steam quality of the evaporator 82 water-steam mixture remains very low, thus avoiding local hot spots that could lead to eventual burnout of the tube wall. The water flows through the FRB in a multipass counter-current manner with respect to the flow of hot gas sent directly to the FRB from the RDFE expander.

Because part-power performance optimization is an inherent requirement. for propulsion engines, the design of a FRB for propulsion must provide both high steam-turn-down ratio and maximum heat recovery (low gas-exit temperature) over a wide power range of the engine. However, in satisfying these requirements, problems relating to both boiler flow stability and operational life are introduced. It is, therefore, an object of the present invention to provide a mode of boiler operation which will enable, under operational requirements, the delivery of the predetermined steam rates needed for optimizing the RDFE performance at particular points on the predetermined power-profile curve. It is recognized that there is a need for controlling gas-side cold corrosion to extend operational life and for maintaining boiler flow stability for any predetermined off-design steam rate.

SUMMARY OF THE INVENTION

In the present invention the flow system of the FRB is modified to maintain the stability and integrity of the boiler by simultaneously providing, under any predetermined off-design, gas-side flow conditions, means for (1) limiting the gas-side cold corrosion of the economizer tubes through tube-wall temperature control, and (2) introducing a controllable sensible component into the heat load of the evaporator, thereby enabling, for any predetermined off-design steam rate, stable evaporator operation at a predetermined design steam quality.

One embodiment of the invention is achieved by adding a recirculation loop to the flow circuit of the economizer. This enables, through diversion of the water flows within the loop, the conditioning of the flows to both the economizer and the steam drum. Simulation of the operation of the flow-system invention along the power-profile curve of the engine has demonstrated the efficacy of the flow-system in enabling, at any particular point on the power-profile curve, the predetermined steam rate needed for optimum performance of the engine.

DESCRIPTION OF THE PREFERRED EMBODIMENT

Figure 1:
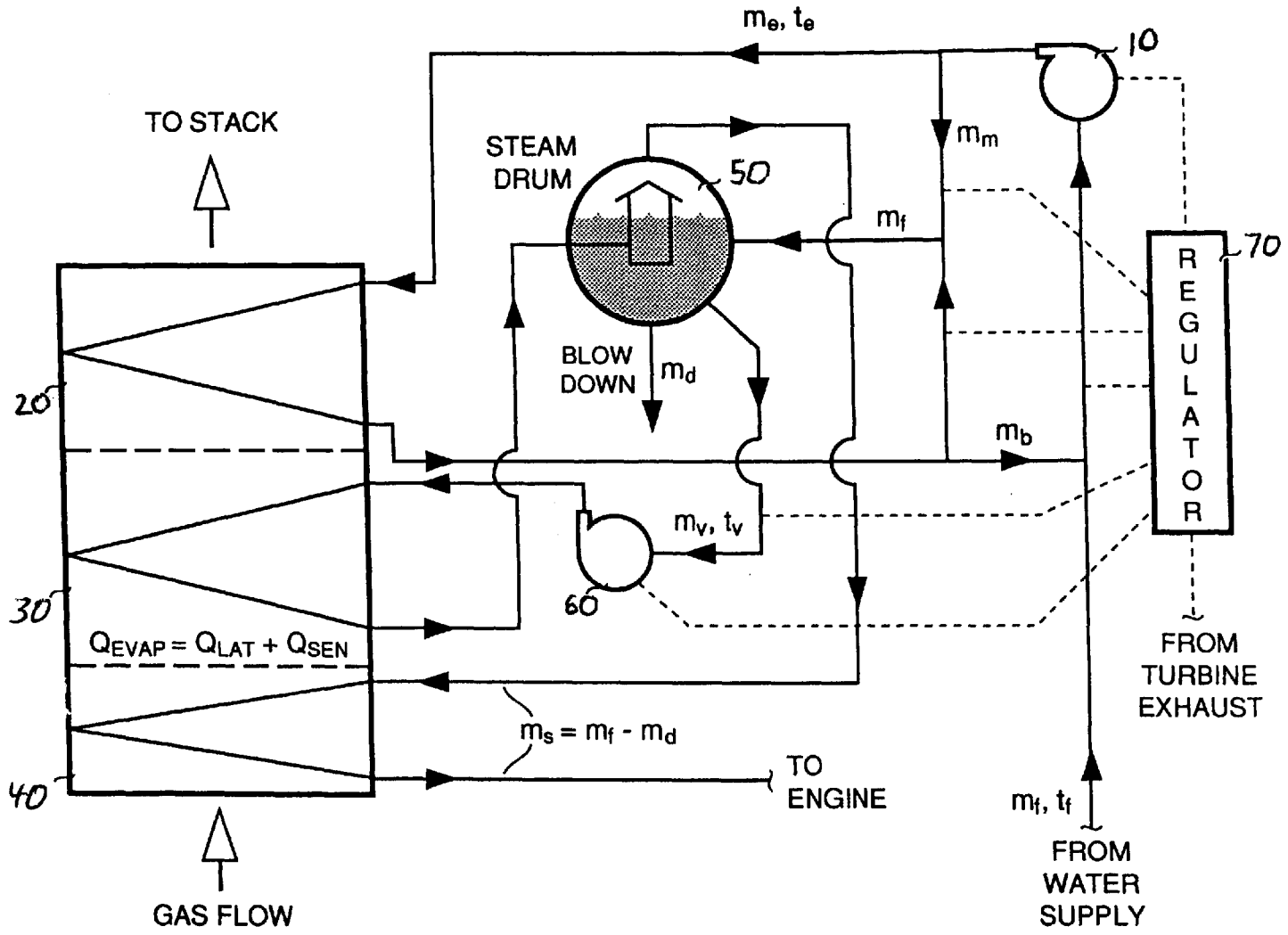
FIG. 1 is a flow schematic of one embodiment of the FRB in accordance with the present invention.

Referring now to the drawings, and more particularly to FIG. 1, there is shown a schematic diagram of a general embodiment of the FRB flow system according to the invention, which includes a suitable flow circuit under the control of a suitable regulating means 70 which may include a plurality of valves and sensing means. All of the heat-exchange components preferably operate with the fluid in counter flow to the engine exhaust gas to ensure maximum efficiency of thermal energy transfer.

Because of the major impact of the sulphuric-acid dew-point on the gas-side corrosion of watertubes in boilers operated by the waste heat of liquid-fueled engines, control of tube metal temperature at the cold end of the FRB is a critical design element that must be satisfied over a wide range of gas-side conditions. Control of tube metal temperature to a predetermined value above the acid dewpoint of the gas is an especially important requirement for a shipboard RDFE, which operates extensively at low-load conditions where the temperature of the gas leaving the expander of the RDFE is quite low.

In the present invention, regulator 70 controls the system to meet the tube metal temperature constraint. As in a conventional FRB, a suitable regulating means is used to draw off, upstream of steam drum 50, a portion $m_b$ of effluent $m_e$ leaving the economizer 20 and mix it with feedwater-flow $m_f$ upstream of feedwater-pump 10. This first mixing means enables the transfer of a predetermined amount of heat from the portion $m_b$ of the effluent $m_e$ to the feedwater flow, whereby, the flowrate and temperature of the feedwater entering the inlet of the economizer are increased. The maintenance of the water-inlet temperature at a predetermined minimum value achieved with the heated feedwater, enables the exit temperature of the gas stream to assume the lowest value consistent with the predetermined water inlet temperature and the overall thermal conductance between the gas-side and water-side streams. A computer simulation of the performance of the FRB control scheme, described in more detail below, has determined the discrete values of flow $m_b$ needed to maintain, along a predetermined power-profile curve, the economizer water inlet temperature in the range of 300–325 degrees F., thus ensuring that the tube metal temperatures remain above the acid dewpoint of the gas.

Recirculation-pump 60 operates at a high recirculation mass ratio, which is recirculation rate/steam rate, thus ensuring that the evaporator 30 always operates at design steam quality; the low value assigned to the design steam quality is critical to the prevention of boiler instability or the formation of hot spots which could eventually lead to evaporator 30 burnout. Optimization of the RDFE performance over its predetermined power-profile curve requires that the FRB deliver the highly superheated steam enabled through generation of the predetermined steam rates at particular points on the power-profile curve. A versatile control scheme is therefore needed to maintain the thermal stability of the evaporator at the predetermined steam rates. To provide this stability, the available heat-transfer area of the evaporator 30 must remain matched to any heat load resulting from the combined effects of the predetermined gas-side flow conditions and the predetermined steam rates at any particular point along the power-profile curve; for the steam-injected plant described by U.S. Pat. No. 5,329,758 issued to Urbach et al., which is hereby incorporated by reference, the maximum turndown ratios of steam and gas flowrates are approximately 6.0 and 3.7, respectively. By reducing the temperature $t_v$ of the water entering the evaporator 30 to a predetermined value below that at saturation, a sensible heat load, and concomitant heat-transfer-area complement, is applied to the evaporator 30. The sensible-area complement (offset) enables the evaporator 30 to operate, at any particular point on a predetermined power-profile curve, at the latent heat load (latent heat-transfer area) consistent with the predetermined steam rate and the overall thermal conductance between the gas-side and water-side streams of the evaporator.

A preferred method for introducing a variable and precisely controllable sensible component into the evaporator heat load is accomplished by a regulating means, made up of a plurality of valves and sensors controlled by regulator 70, that draws off, downstream of feedwater-pump 10, a predetermined portion $m_m$ of the feedwater mixture $m_f+m_b$ and mixes it with the portion $m_e-m_b$ of the economizer effluent being delivered to steam-drum 50. This second mixing process is effective for transferring a predetermined amount of heat from the portion of heated economizer effluent to the portion of feedwater mixture and for maintaining the quantity of the water mixture entering the steam drum 50 equal to feedwater-flow $m_f$, herein referred to as makeup water and defined as the sum of $m_s$ and $m_d$ which are the predetermined flowrates of steam and drum blowdown, respectively. Through this second mixing process for increasing the subcooling of the water mixture entering the steam drum and the subsequent mixing of this water with the resident steam-drum water, the subcooling of the water fed to the evaporator 30 at temperature $t_v$ is also increased.

Figure 4:
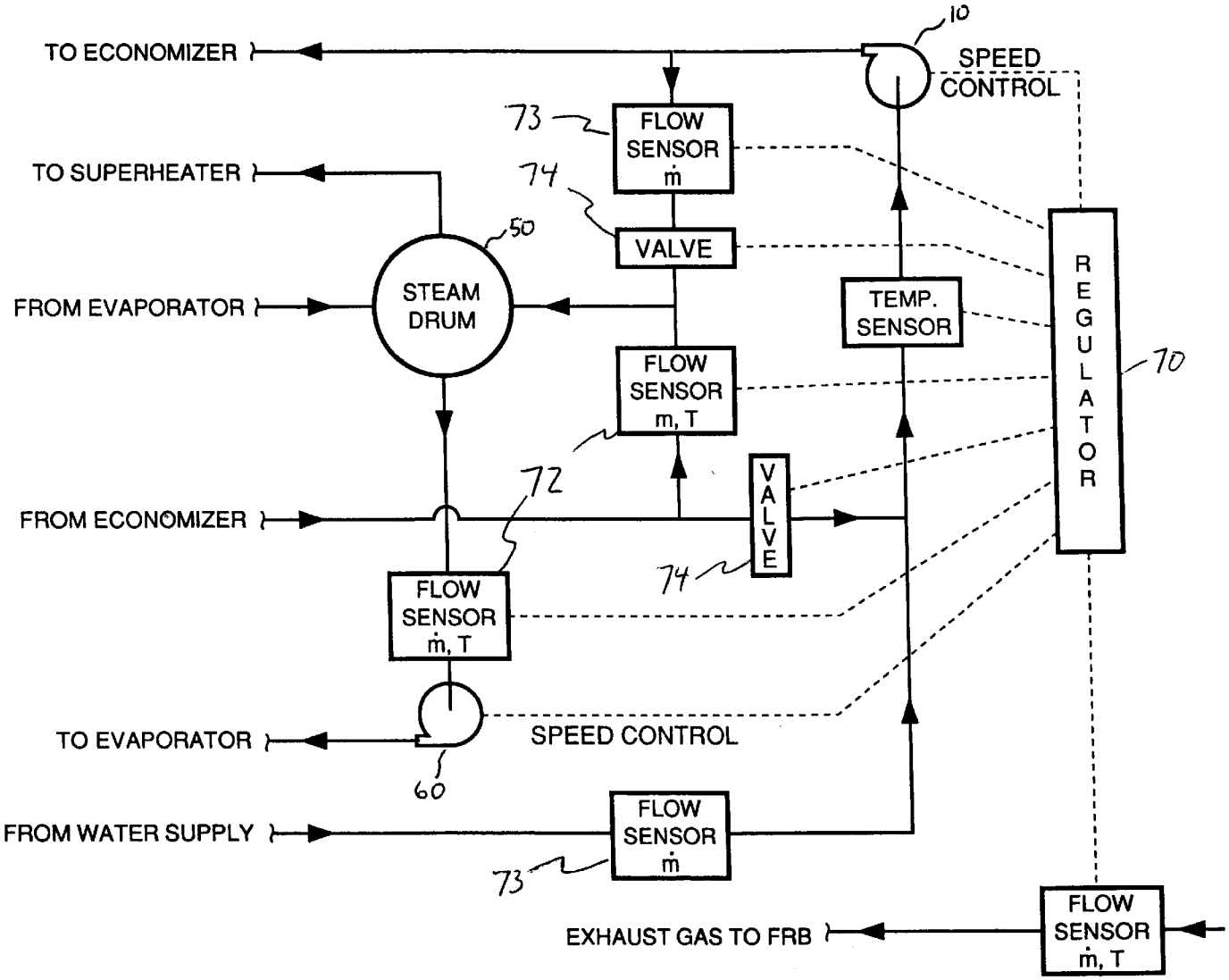
FIG. 4 is a schematic diagram of one possible flow-control system for the FRB in accordance with the present invention in FIG. 1.

One possible method of controlling the flow within the economizer recirculation loops that may be used with the present invention is shown schematically in FIG. 4. The regulator 70 can include any conventional components that sense levels of signals arriving from sensors 72, 73 and then send out signals to actuate the various flow-control valves 74 in response to detection of certain levels of the sensed signals. The regulator 70 can be realized by using electrical, electromechanical or electrohydraulic components or, alternatively, by using a suitably programmed microprocessor or programmable logic device. On the basis of input from sensors of the inlet temperatures of the economizer 20 and evaporator 30, regulator 70 adjusts the water flow rates of the FRB to simultaneously satisfy both of the FRB operating constraints at any point along the power-profile curve.

Validation of the performance of the invention of FIG. 1 was obtained by incorporating the present invention into the computer simulation software for the off-design operation of the RDFE described by U.S. Pat. No. 5,329,758 issued to Urbach et al. The computer simulation used real-gas data with a point-design program and a map-matching program. These two programs allow for cross verification on their consistency with respect to first and second law thermodynamic checks. In performing the thermodynamic coupling of the FRB invention to the engine model, the boiler feedwater supply temperature and operating pressure, given in Table 1, were held constant over engine power levels ranging between 10% and 100%. The table also shows that, while maintaining the heat-load matching within the evaporator 30 at all points along the power-profile curve, the water-inlet temperature of the economizer 20 could be held in the range of 301–325 F., which is well above the acid dewpoint of the gas entering the FRB.

TABLE 1

OPERATING CONSTRAINTS EMPLOYED IN THE COMPUTER SIMULATION OF THE FRB FLOW-SYSTEM INVENTION OF FIG. 1

| | |
|---|---|
| Ambient Temperature | 100 deg. F. |
| FRB Steam-Drum Pressure | 560 psia |
| FRB Feedwater Temperature | 85 deg. F. |
| FRB Economizer Water-Inlet Temperature | 301–325 deg. F. |

Figure 2:
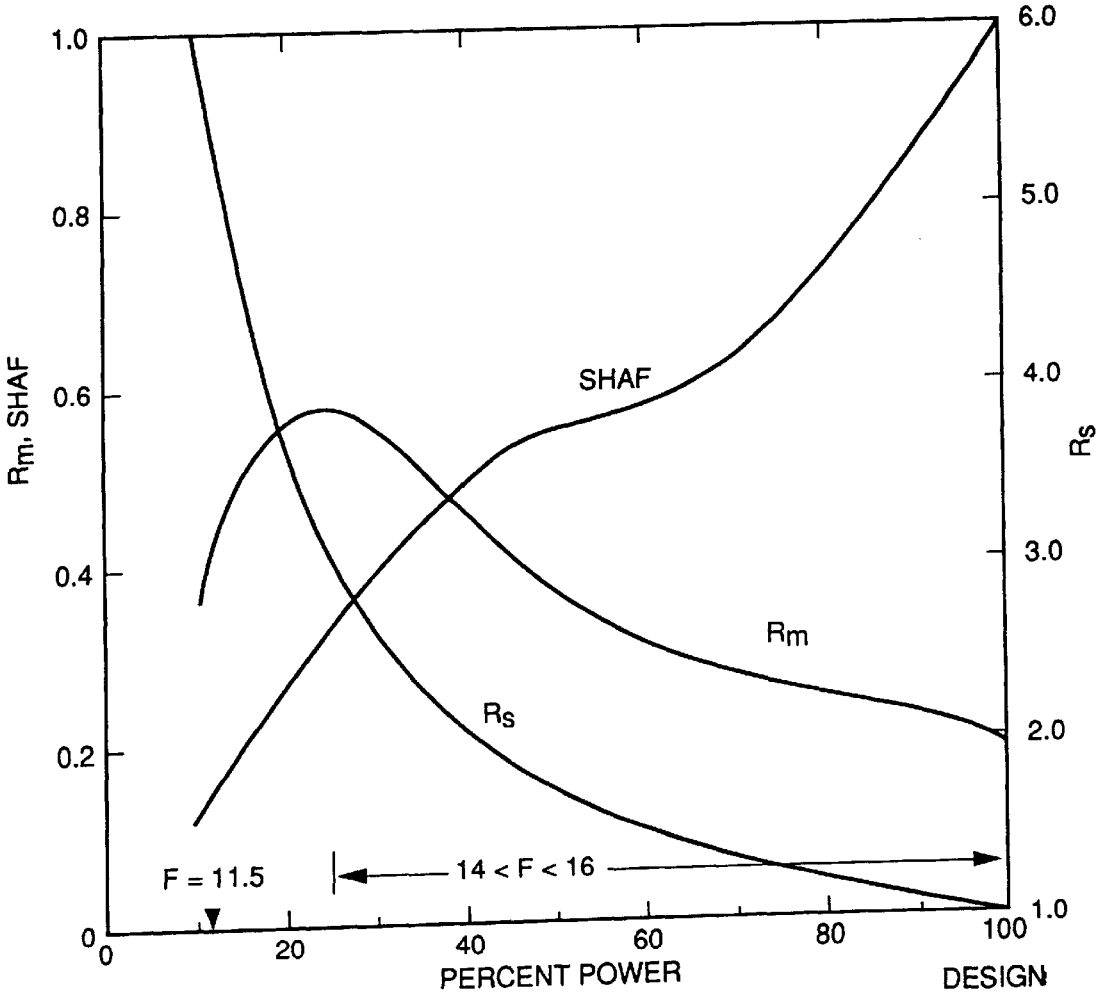
FIG. 2 is a graph illustrating, through computer simulation of the FRB flow-system in accordance with the present invention, the interrelationships between the drum-water mixing ratio and the evaporator sensible-heat augmentation factor and steam rate at particular points along the predetermined power-profile curve of the performance-optimized RDFE.
Figure 3:
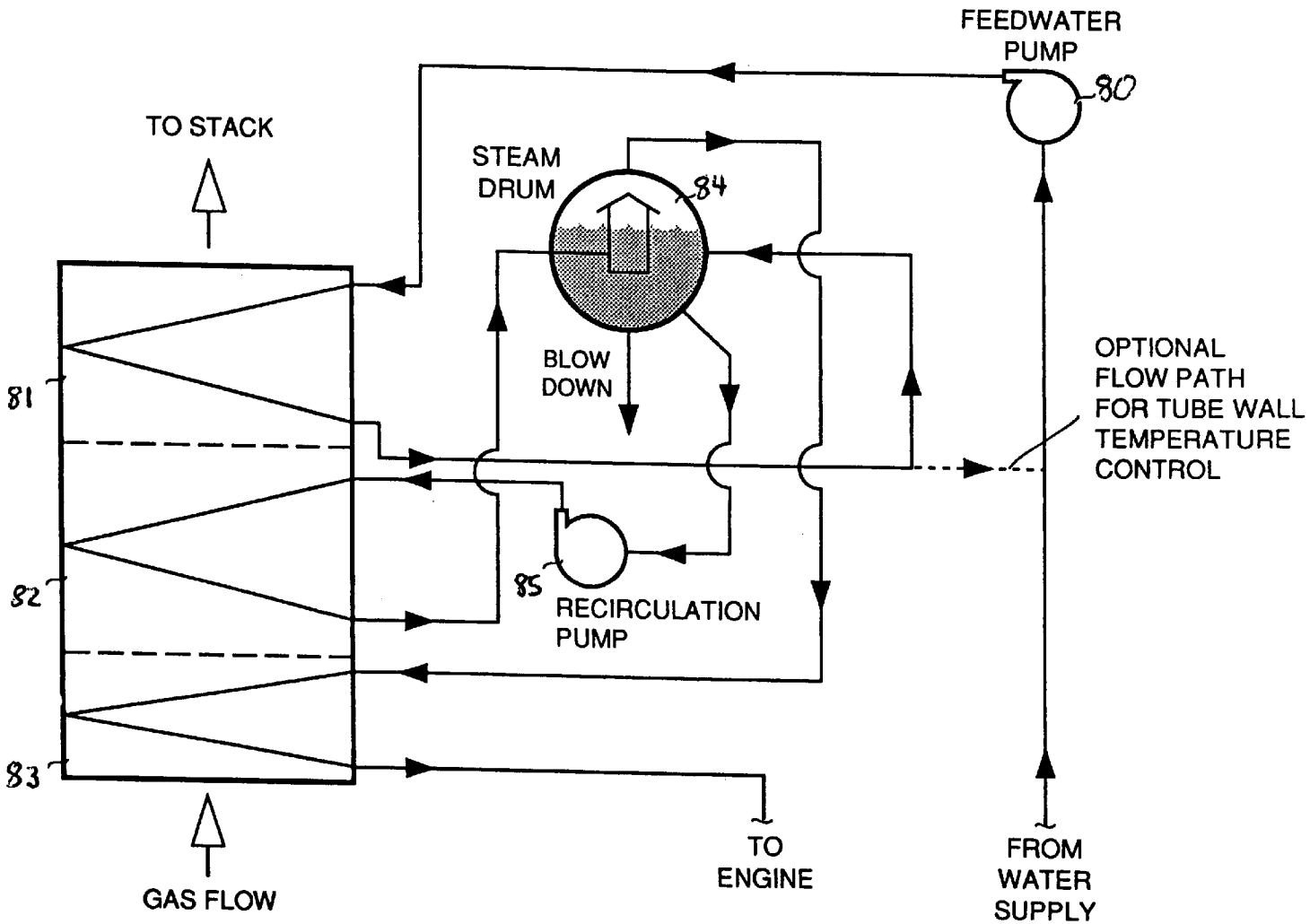
Fig. 3. (PRIOR ART)
FIG. 3 is a flow schematic of a conventional forced-recirculation, heat-recovery boiler commonly employed in stationary gas-turbine power plants.

From the results of the simulation of the off-design performance of the FRB in accordance with the present invention, it is possible to describe the manner in which critical system parameters vary over the power-profile curve. FIG. 2 illustrates the interrelationships between the drum-water mixing ratio and the evaporator sensible-heat augmentation factor (SHAF) and steam rate at particular points along a predetermined power-profile curve. The SHAF expresses the sensible heat load of the evaporator 30 as a fraction of its design-point value. It is seen that this load is nearly proportional to power in the ranges of 10–45% and 70–100% of rated power. The variation in SHAF reflects the net affect of the rates of change of both steam-rate ratio R, and the overall thermal conductance between the gas-side and water-side streams of the evaporator 30. Since, as power drops from 70 to 45%, the steam rate (latent heat load) falls faster than the thermal conductance, a more rapid reduction in the latent-transfer area occurs, inducing a slower rate of decrease of the sensible-heat offset. However, as long as power is not reduced to a value below 25%, the drum-water mixing ratio $R_m$ of the second mixing means must always increase to provide the subcooling (sensible heat) needed to offset the diminishing latent-transfer-area requirement. When the power drops below 25 percent, rapid changes in the gas-side flow conditions cause thermal conductance to fall much faster than the steam rate. This change causes a sudden increase in the required latent-transfer area and, consequently, the rapid turndown of the mixing ratio to reduce the sensible-heat offset. The data show that, at all points along the power-profile curve, the values of the mixing ratio remain below 60 percent while providing a sensible-heat fraction F approaching 16 percent.

The computer simulation confirms that, at any particular point along the power-profile curve, there is a unique combination of flows $m_m$ and $m_b$ that simultaneously provide the correct inlet temperatures to the economizer 20 and evaporator 30. Regulation of the economizer-loop flows is coordinated with the speed of feedwater-pump 10 to ensure that a safe margin of subcooling of the economizer effluent is maintained. The simulation also shows that, at any particular point on the power-profile curve, the FRB operating constraints are met when the economizer-flow $m_e$ is approximately twice the feedwater-flow $m_f$. These higher flow rates do increase the parasitic work of feedwater-pump 10, which, in addition to operating at higher flow, must develop higher head to overcome the higher flow losses associated with the economizer-loop components. However, the simulation confirms that the impact on the overall thermal efficiency of said RDFE is quite nominal.

In light of the above teachings, many modifications and variations of the present invention are possible. Therefore, those skilled in the art will recognize that, within the scope of the appended claims, the invention may be practiced otherwise than as specifically described.

What is claimed is:

1. A heat-recovery, steam-generator flow system in a recuperative dual-fluid engine comprising:

a supply of feedwater;

a first mixing means for combining said feedwater with a predetermined portion of heated economizer effluent to raise the temperature of said feedwater to a predetermined value for supply as heated feedwater to an economizer heat exchange means and a steam drum;

a feedwater pump for circulating said heated feedwater;

control means for diverting a first portion of said heated feedwater to said economizer heat exchange means and a second portion of said heated feedwater to a second mixing means;

said first portion of said heated feedwater flows through said economizer heat exchange means for supply as heated economizer effluent to said first mixing means and said second mixing means;

said second portion of said heated feedwater flows through said second mixing means and is mixed with a portion of heated economizer effluent to subcool the water supplied to a steam-drum by a predetermined amount;

a recirculation pump for delivering said subcooled water mixture to an evaporator heat-exchange means whereby a portion of said subcooled water is vaporized to achieve a predetermined recirculation mass ratio in the water/steam mixture returned to said steam-drum;

a superheater heat exchange means for receiving a predetermined quantity of steam from said steam drum and heating said steam to a predetermined superheat temperature for supply to said recuperative dual-fluid engine;

regulating means for regulating said first mixing means, said second mixing means and said control means.

2. A heat-recovery steam-generator flow system as in claim 1, wherein said second mixing means includes a valve and sensor means responsive to said regulating means.

3. A heat-recovery steam-generator flow system as in claim 2 wherein said valve of said second mixing means is responsive to a control signal for increasing the flow through said valve when the degree of subcooling of steam-drum water mixture being fed to said evaporator heat exchange means is less than said predetermined value and for reducing the flow through said valve when said subcooling is greater than said predetermined value.

4. A heat-recovery steam-generator flow system as in claim 3, wherein the flowrate of steam-drum water mixture fed from said second mixing means is maintained, at any said predetermined steam rate, equal to a predetermined flow of said feedwater.

5. A heat-recovery steam-generator flow system as in claim 4 wherein said first mixing means includes a mixing valve and sensor means responsive to said regulating means.

6. A heat-recovery steam-generator flow system as in claim 5 wherein said valve of said first mixing means includes a means responsive to a control signal for increasing the flow of water through said valve when the temperature of said heated feedwater being fed to said economizer heat exchange means is less than said predetermined value and for reducing the flow of water through said valve when said temperature is greater than said predetermined value.

7. A heat-recovery steam-generator flow system as in claim 6, wherein said feedwater pump includes a means responsive to a control signal for increasing the flow of water through said economizer heat exchange means when the heated economizer effluent temperature is above said predetermined value and for reducing said flow when said temperature is below s aid predetermined value.

8. A heat-recovery steam-generator flow system as in claim 7, wherein said recirculation pump is responsive to a control signal for increasing the flow of water fed to said evaporator heat exchange means when the recirculation mass ratio is below said predetermined value and for reducing said flow when said mass ratio is above said predetermined value.

9. A method of operating a forced recirculation boiler so as to limit gas side cold corrosion of boiler tubes and to introduce a controllable sensible component into heat load of an evaporator of said boiler to enable stable evaporator operation at a predetermined design steam quality, comprising the steps of:

a) supplying feedwater to said forced recirculation boiler;

b) preheating said feedwater;

c) pumping said preheated feedwater through an economizer thereby producing economizer effluent;

d) diverting a portion of said preheated feedwater prior to passage through said economizer;

e) mixing said diverted portion of said preheated feedwater with said economizer effluent thereby subcooling said economizer effluent;

f) flowing said subcooled economizer effluent to a steam drum for collection thereby producing steam-drum water;

g) flowing said steam drum water through an evaporator, thereby converting a portion of said steam-drum water into steam and discharging water/steam mixture to said steam drum;

h) flowing steam from said steam drum through a superheater.

* * * * *